US009583819B2

(12) United States Patent
Iso et al.

(10) Patent No.: US 9,583,819 B2
(45) Date of Patent: Feb. 28, 2017

(54) ANTENNA DEVICE INCLUDING A PHASE SHIFTER AND A FEEDING PORTION CONFIGURED AS A TRIPLATE LINE WITH A CENTER CONDUCTOR

(71) Applicant: Hitachi Metals, Ltd., Tokyo (JP)

(72) Inventors: Naoki Iso, Hitachi (JP); Nobuaki Kitano, Hitachi (JP); Tomoyuki Ogawa, Hitachi (JP); Yoshiaki Ishigami, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 330 days.

(21) Appl. No.: 14/243,776

(22) Filed: Apr. 2, 2014

(65) Prior Publication Data

US 2014/0320371 A1 Oct. 30, 2014

(30) Foreign Application Priority Data

Apr. 24, 2013 (JP) ..... 2013-91604

(51) Int. Cl.
*H01Q 19/06* (2006.01)
*H01Q 1/24* (2006.01)
(Continued)

(52) U.S. Cl.
CPC ..... *H01Q 1/246* (2013.01); *H01Q 3/36* (2013.01); *H01Q 21/0081* (2013.01); *H01Q 21/26* (2013.01)

(58) Field of Classification Search
CPC ..... H01Q 1/246; H01Q 21/0081; H01Q 3/36; H01Q 21/26
(Continued)

(56) References Cited

U.S. PATENT DOCUMENTS 5,510,803 A * 4/1996 Ishizaka ..... H01Q 21/061 343/700 MS
7,283,015 B1 10/2007 Rockenbauch
(Continued)

FOREIGN PATENT DOCUMENTS

JP H05-243804 A 9/1993
JP 09-148835 6/1997
(Continued)

OTHER PUBLICATIONS

Japanese Office Action dated Jun. 14, 2016 with an English translation thereof.
(Continued)

*Primary Examiner* — Hoanganh Le
(74) *Attorney, Agent, or Firm* — McGinn IP Law Group, PLLC

(57) ABSTRACT

An antenna device includes an input/output portion for a high frequency signal to be input or output, a distributing portion for distributing the high frequency signal input to the input/output portion into a plurality of high frequency signals, a phase shifting portion for imparting the plurality of high frequency signals with a predetermined amount of phase shift, and a feeding portion for feeding a plurality of antenna elements with the plurality of high frequency signals imparted with the predetermined amount of phase shift to cause the plurality of antenna elements to radiate the plurality of high frequency signals. The feeding portion is configured as a triplate line with a center conductor placed between one pair of parallel plate shaped outer conductors.

6 Claims, 12 Drawing Sheets

100 TRIPLATE LINE { 30 FIRST GROUND PLATE (FIRST OUTER CONDUCTOR); 40 CENTER CONDUCTOR; 50 SECOND GROUND PLATE (SECOND OUTER CONDUCTOR) }

(51) Int. Cl.
*H01Q 3/36* (2006.01)
*H01Q 21/00* (2006.01)
*H01Q 21/26* (2006.01)

(58) Field of Classification Search
USPC ..... 343/700 MS, 848, 846, 853
See application file for complete search history.

(56) References Cited

U.S. PATENT DOCUMENTS

| | | | | |
|---|---|---|---|---|
| 2004/0080380 | A1 | 4/2004 | Marino | |
| 2011/0050534 | A1* | 3/2011 | Shimayama | H01P 5/028 343/850 |
| 2012/0050094 | A1* | 3/2012 | Nakabayashi | G01S 7/03 342/174 |
| 2012/0306698 | A1* | 12/2012 | Warnick | H01Q 5/35 342/372 |

FOREIGN PATENT DOCUMENTS

| | | | |
|---|---|---|---|
| JP | 3231985 | B2 | 11/2001 |
| JP | 2002-033603 | A | 1/2002 |
| JP | 2010-273048 | A | 12/2010 |

OTHER PUBLICATIONS

Japanese Office Action dated Oct. 4, 2016 with an English translation thereof.

* cited by examiner

| | |
|---|---|
| 100 TRIPLATE LINE | 30 FIRST GROUND PLATE (FIRST OUTER CONDUCTOR)<br>40 CENTER CONDUCTOR<br>50 SECOND GROUND PLATE (SECOND OUTER CONDUCTOR) |

ANTENNA DEVICE INCLUDING A PHASE SHIFTER AND A FEEDING PORTION CONFIGURED AS A TRIPLATE LINE WITH A CENTER CONDUCTOR

The present application is based on Japanese patent application No. 2013-91604 filed on Apr. 24, 2013, the entire contents of which are incorporated herein by reference.

BACKGROUND OF THE INVENTION

1. Field of the Invention

This invention relates to an antenna device for feeding a plurality of antenna elements with a high frequency signal imparted with an amount of phase shift by a phase shifter.

2. Description of the Related Art

As an example of conventional antenna devices, it has been known an antenna device with a combination of a rotary phase shifter and a phase shift amount adjustment transmission line of a predetermined length, so that the tilt angle is altered by adjusting the rotation angle of the rotary phase shifter. This antenna device is configured so that excitation power inputted to an input terminal is distributed by a power distributor, and this distributed power is input to the rotary phase shifter, and output of the rotary phase shifter is input to the phase shift adjusting transmission line and output of the phase shift adjusting transmission line is fed to an antenna element via a feed line. For example, JP Patent No. 3231985 discloses such a conventional antenna device.

SUMMARY OF THE INVENTION

However, in the conventional antenna device, a coaxial cable with a dielectric for insulating a center conductor and an outer conductor as the feed line has been used, the dielectric loss in the coaxial cable is not negligible, and there is a limit on the enhancement of the efficiency of the antenna device. Further, when the power distributor, the phase shift adjusting transmission line, and the feed line are different in line structure, non-negligible loss in the connecting portion thereof may occur.

Accordingly, it is an object of the present invention to provide an antenna device, which lowers dielectric loss in a feed line providing power to antenna elements to thereby ensure the enhancement of the efficiency, and which allows omission of a transmission line connecting portion to suppress the occurrence of loss.

According to an embodiment of the invention, an antenna device comprises:

an input/output portion for a high frequency signal to be input or output;

a distributing portion for distributing the high frequency signal input to the input/output portion into a plurality of high frequency signals;

a phase shifting portion for imparting the plurality of high frequency signals with a predetermined amount of phase shift; and a feeding portion for feeding a plurality of antenna elements with the plurality of high frequency signals imparted with the predetermined amount of phase shift to cause the plurality of antenna elements to radiate the plurality of high frequency signals, wherein the feeding portion is configured as a triplate line with a center conductor placed between one pair of parallel plate shaped outer conductors.

In the embodiment, the following modifications and changes can be made.

(i) The phase shifting portion is configured as a dielectric phase shifter comprising a triplate line with a center conductor placed between one pair of parallel plate shaped outer conductors, and first and second dielectrics provided partially on and under the center conductor therebetween and movably in a longitudinal direction of the center conductor, the first and second dielectrics comprising a varying width in the longitudinal direction.

(ii) The distributing portion is configured as a triplate line with a center conductor placed between one pair of parallel plate shaped outer conductors.

(iii) The distributing portion is configured as including the phase shifting portion.

(iv) The distributing portion, the phase shifting portion, and the feeding portion are configured as a series of triplate lines each with a center conductor placed between one pair of parallel plate shaped outer conductors.

(v) The triplate lines each include a first ground plate with the antenna elements fixed thereto, and a second ground plate arranged parallel to and at a predetermined separation from the first ground plate, as the one pair of outer conductors.

(vi) The phase shifting portion has a loss of not greater than 0.7 dB in a frequency band of not lower than 1.4 GHz and not higher than 2.2 GHz.

Points of the Invention

The antenna device according to the present invention can lower dielectric loss in a feed line providing power to the antenna elements to thereby ensure the enhancement of the efficiency, and also allows omission of a transmission line connecting portion to enable the suppression of the occurrence of loss.

BRIEF DESCRIPTION OF THE DRAWINGS

The preferred embodiments according to the invention will be explained below referring to the drawings, wherein.

Figure 1A:
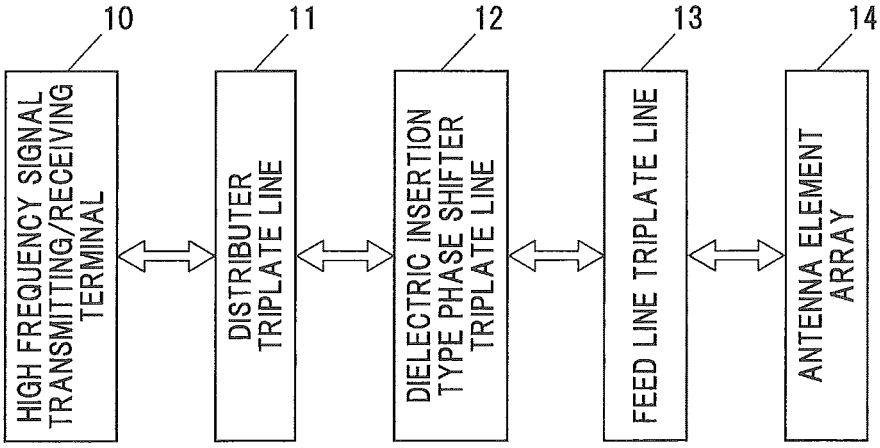
FIG. 1A is a block diagram illustrating a mobile phone base station antenna device in an embodiment according to the present invention.

DETAILED DESCRIPTION OF THE PREFERRED EMBODIMENTS FIG.

1A is a block diagram showing a configuration example of a schematic of a mobile phone base station antenna device 1 in an embodiment according to the present invention. This mobile phone base station antenna device 1 includes a high frequency signal transmitting/receiving terminal 10, a distributor triplate line 11, a dielectric phase shifter triplate line 12, and a feed line triplate line 13, and an antenna element array 14 with antenna elements arranged in an array.

In this configuration, when excitation power is input to the high frequency signal transmitting/receiving terminal 10 as a high frequency transmission signal, the excitation power is distributed by the distributor triplate line 11 as a distributing portion. The excitation power distributed is imparted with a predetermined amount of phase shift by the dielectric phase shifter triplate line 12 as a respective corresponding phase shifting portion, and is input to the feed line triplate line 13 as a respective corresponding feeding portion. The excitation power provided to the plurality of feed line triplate lines 13 in this manner is fed to the respective corresponding antenna elements of the antenna element array 14, and is radiated with a predetermined directivity from the antenna elements.

Figure 1B:
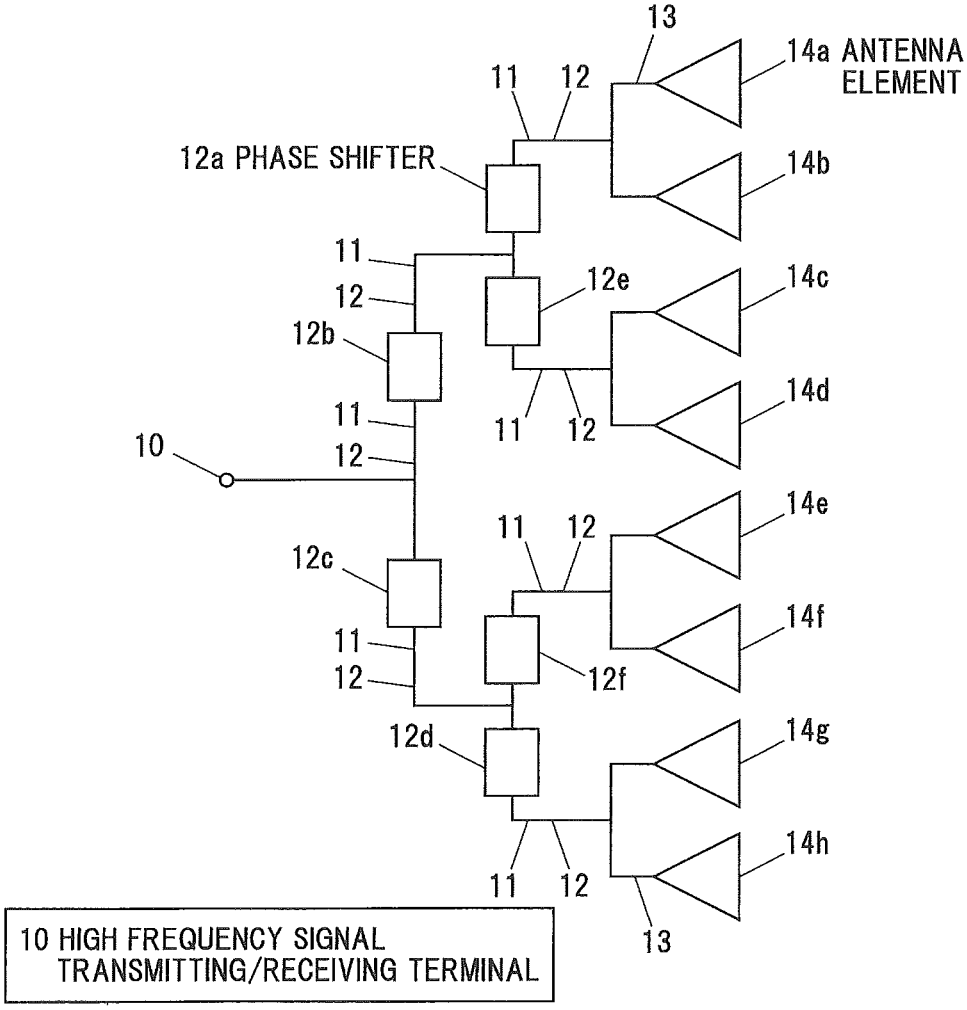
FIG. 1B is a block diagram showing that a distributor triplate line includes a dielectric phase shifter triplate line in the mobile phone base station antenna device.

FIG. 1B is a diagram showing a configuration example of the mobile phone base station antenna device 1 shown in more detail in the block diagram of FIG. 1A. The mobile phone base station antenna device 1 includes the high frequency signal transmitting/receiving terminal 10 for a high frequency signal output from a high frequency circuit (not shown) or the like to be input, the distributor triplate line 11 for distributing the high frequency signal input to the high frequency signal transmitting/receiving terminal 10, the dielectric phase shifter triplate line 12 formed with dielectric phase shifters 12*a* to 12*f*, and the antenna element array 14 formed with the plurality of antenna elements 14*a* to 14*h*.

In FIG. 1B, as one example, the six phase shifters and the eight antenna elements are shown, but the numbers of phase shifters and antenna elements are not limited to the numbers illustrated. Further, in FIG. 1A, for convenience, the distributor triplate line 11 and the dielectric phase shifter triplate line 12 are described separately, but in the present embodiment, as shown in FIG. 1B, the distributor triplate line 11 is configured in a manner that includes the dielectric phase shifter triplate line 12.

Figure 2:
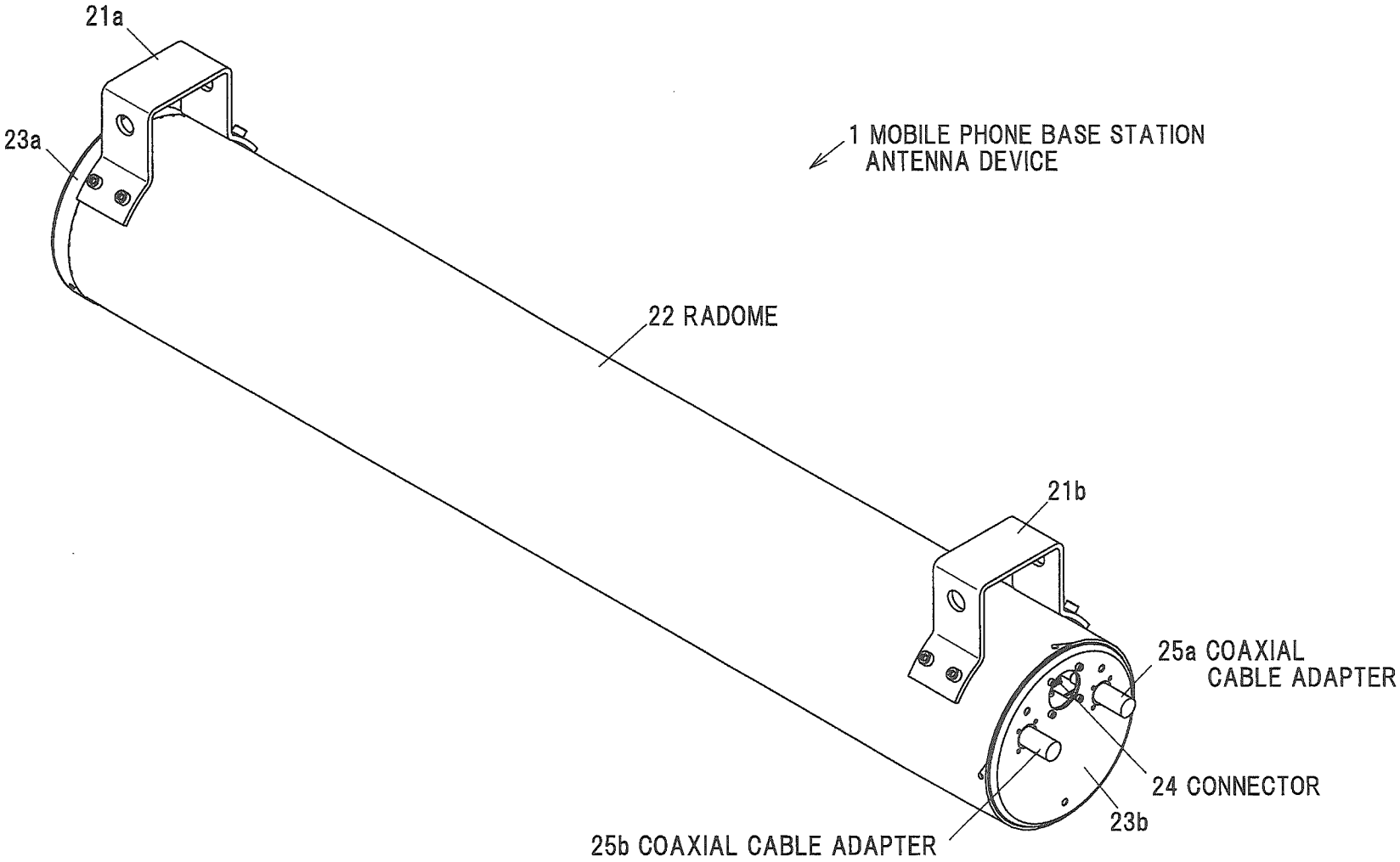
FIG. 2 is a perspective view showing the mobile phone base station antenna device.

FIG. 2 is a perspective view showing an appearance of the mobile phone base station antenna device 1. The mobile phone base station antenna device 1 is configured so as to receive the high frequency signal transmitting/receiving terminal 10, the distributor triplate line 11, the dielectric phase shifter triplate line 12, the feed line triplate line 13, the antenna element array 14 and the like in a cylindrical radome 22.

The radome 22 is closed by antenna caps 23*a* and 23*b* at both ends, and is mounted to an antenna tower or the like with mounting brackets 21*a* and 21*b* so that its longitudinal direction is a vertical direction. The antenna cap 23*b* includes a connector 24 for providing external power to a linear motor unit (denoted by reference numeral 53 in FIG. 5) to be described later, and coaxial cable adapters 25*a* and 25*b* for providing excitation power to antenna elements (denoted by reference numeral 32 in FIG. 3) which will be described later and which constitute the antenna element array 14 in FIGS. 1A and 1B. The coaxial cable adapters 25*a* and 25*b* act as the high frequency signal transmitting/receiving terminal 10.

Figure 3:
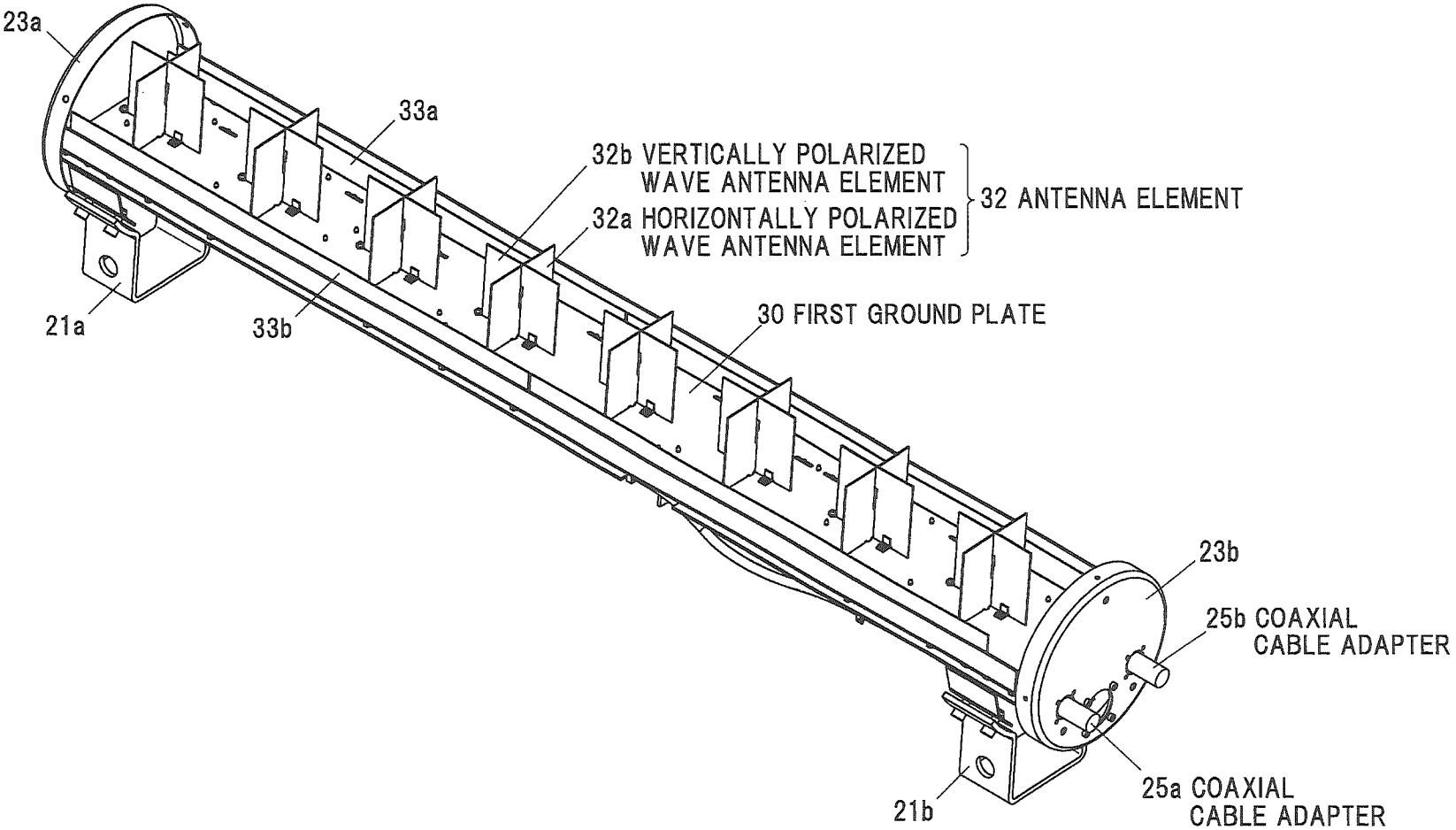
FIG. 3 is a perspective view showing antenna elements on a first ground plate (first outer conductor) in the mobile phone base station antenna device.

FIG. 3 is a perspective view showing the antenna elements 32 arranged on a first ground plate 30 in the radome 22.

The antenna elements 32 include a respective horizontally polarized antenna element 32*a* and a respective vertically polarized antenna element 32*b*. The respective horizontally polarized antenna element 32*a* corresponds to a horizontally polarized coaxial cable (denoted by reference numeral 55*a* in FIG. 5) to be described later which is connected to the coaxial cable adapter 25*a*, while the respective vertically polarized antenna element 32*b* corresponds a vertically polarized coaxial cable (denoted by reference numeral 55*b* in FIG. 5) to be described later which is connected to the coaxial cable adapter 25*b*. Further, on both sides in its width direction perpendicular to its longitudinal direction, the first ground plate 30 includes side plates 33*a* and 33*b*.

Figure 4:
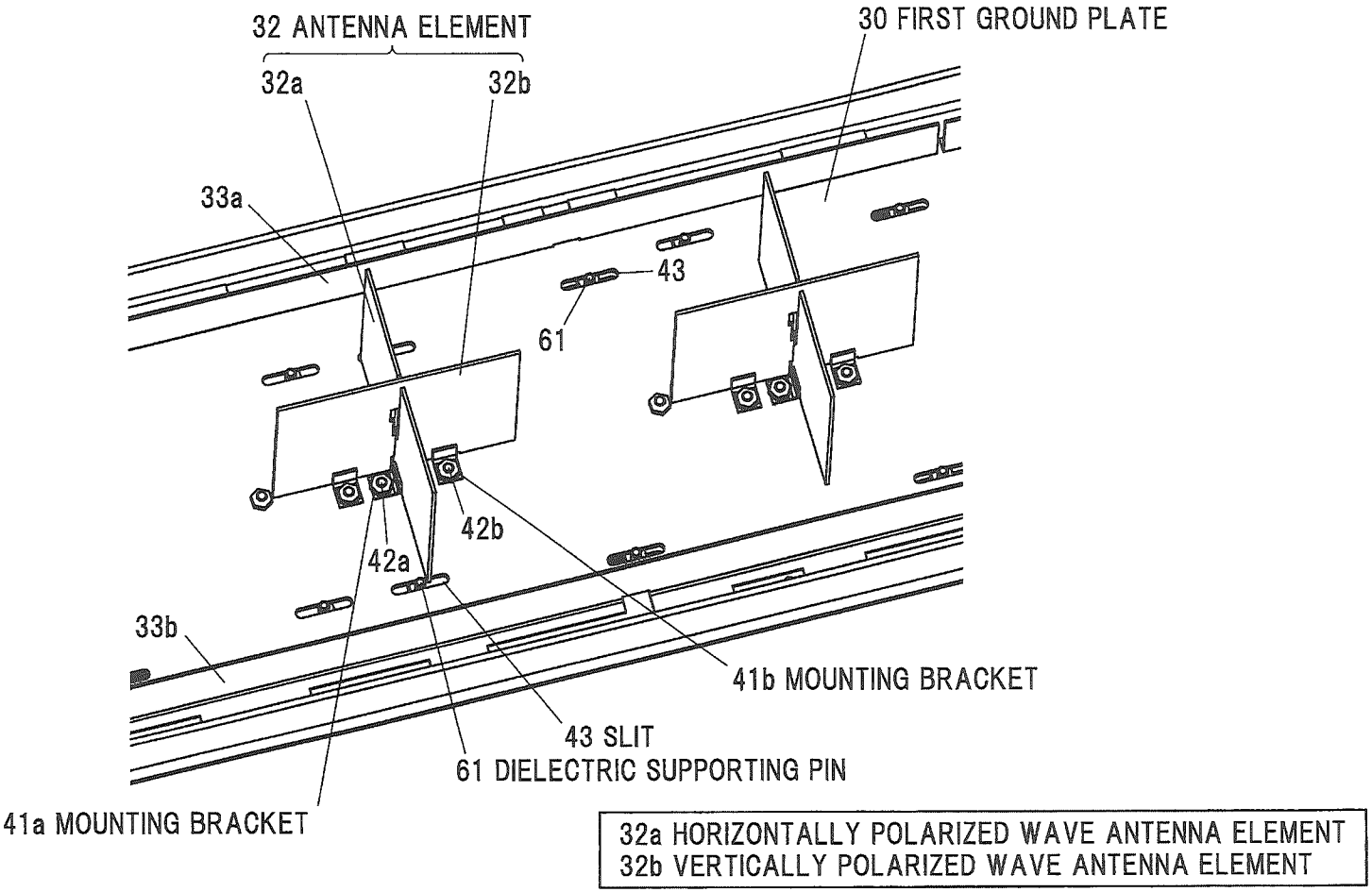
FIG. 4 is a perspective view showing the enlarged antenna elements in FIG. 3.

FIG. 4 is a perspective view showing the enlarged antenna elements 32 arranged on the first ground plate 30.

The respective horizontally polarized antenna element 32*a* is attached to the first ground plate 30 via an L-shaped mounting bracket 41*a* with a bolt and nut 42*a*. The respective vertically polarized antenna element 32*b* is attached to the first ground plate 30 via an L-shaped mounting bracket 41*b* with a bolt and nut 42*b*. The respective horizontally polarized antenna element 32*a* and the respective vertically polarized antenna element 32*b* are formed with a conductor pattern not shown on the dielectric substrate, and the feed line triplate line 13 is connected by a lead wire not shown to the conductor pattern.

The first ground plate 30 acts as a reflector that reflects radio waves radiated from the respective horizontally polarized antenna element 32*a* and the respective vertically polarized antenna element 32*b*. The first ground plate 30 is formed with a plurality of slits 43 as elongated holes for guiding a dielectric supporting pin 61 to be described later.

Figure 5:
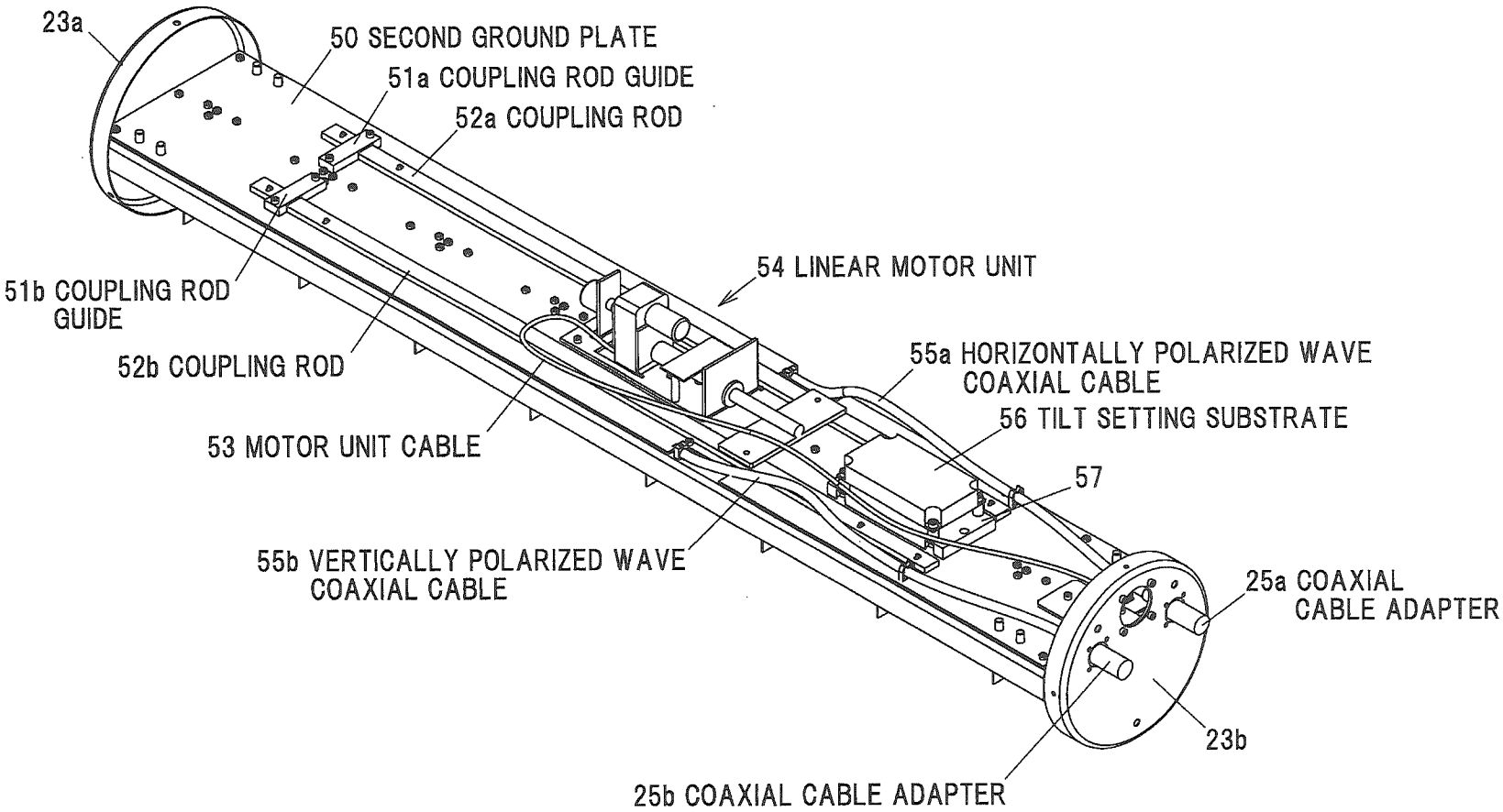
FIG. 5 is a perspective view showing a linear motor unit, a coupling rod and the like on a second ground plate (second outer conductor) in the mobile phone base station antenna device.

FIG. 5 is a perspective view showing the mobile phone base station antenna device 1 from which the radome 22 is detached and which is viewed from the opposite side in FIG. 3.

As shown in FIG. 5, the mobile phone base station antenna device 1 includes a second ground plate 50 arranged parallel to and at a predetermined separation from the first ground plate 30 on which the antenna elements 32 are arranged, coupling rods 52*a* and 52*b* which are guided by coupling rod guides 51*a* and 51*b*, and which are coupled to the dielectric supporting pins 61 to be described later, to move the dielectric supporting pins 61 in the longitudinal direction of the first ground plate 30, a linear motor unit 54 to be provided with a driving power supply by a motor unit cable 53, a horizontally polarized coaxial cable 55*a* and a vertically polarized coaxial cable 55*b* for providing a signal to a center conductor (denoted by reference numeral 40 in FIG. 6) which will be described later and which is located between the first ground plate 30 and the second ground plate 50, which are one pair of outer conductors for a triplate line, and a tilt setting substrate 56 which is placed on a mount 57 to set a tilt angle.

Figure 6:
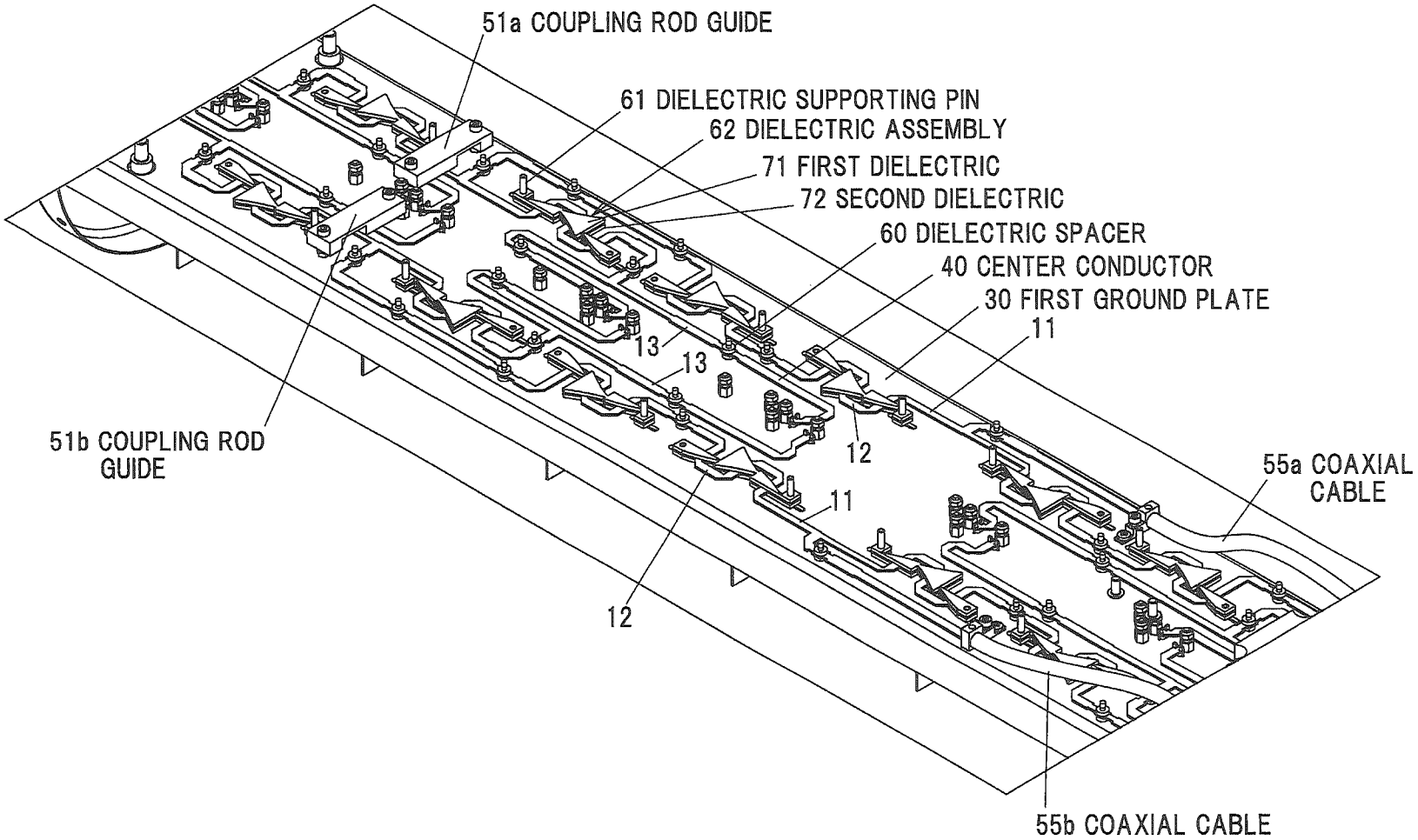
FIG. 6 is a perspective view showing a triplate line and the like on the first ground plate (second outer conductor) in the mobile phone base station antenna device.

FIG. 6 is a perspective view showing a configuration of a portion interposed between the first ground plate 30 and the second ground plate 50 by further detaching the second ground plate 50 in FIG. 5.

Between the first ground plate 30 and the second ground plate 50 are arranged the distributor triplate line 11 described in FIGS. 1A and 1B, the dielectric phase shifter triplate line 12, and the center conductor 40 of the feed line triplate line 13. As shown in FIG. 6, in this embodiment, the distributor triplate line 11, the dielectric phase shifter triplate line 12, and the feed line triplate line 13 are configured as a series of triplate lines.

The center conductor 40 is arranged parallel to and between the first ground plate 30 and the second ground plate 50 with an impedance matching dielectric spacer 60 (indicated by reference numeral 60 in FIGS. 10A and 10B) to be described later. The center conductor 40 is made of a metal material such as copper.

The center conductor 40 is partially located between a first dielectric plate 71 and a second dielectric plate 72 in a dielectric assembly 62 having the first dielectric plate 71 and the second dielectric plate 72 which constitute the aforementioned phase shifters 12*a* to 12*f*. The dielectric assembly 62 is movable in the longitudinal direction of the first ground plate 30 by the coupling rods 52*a* and 52*b* via the dielectric supporting pins 61.

Figure 7:
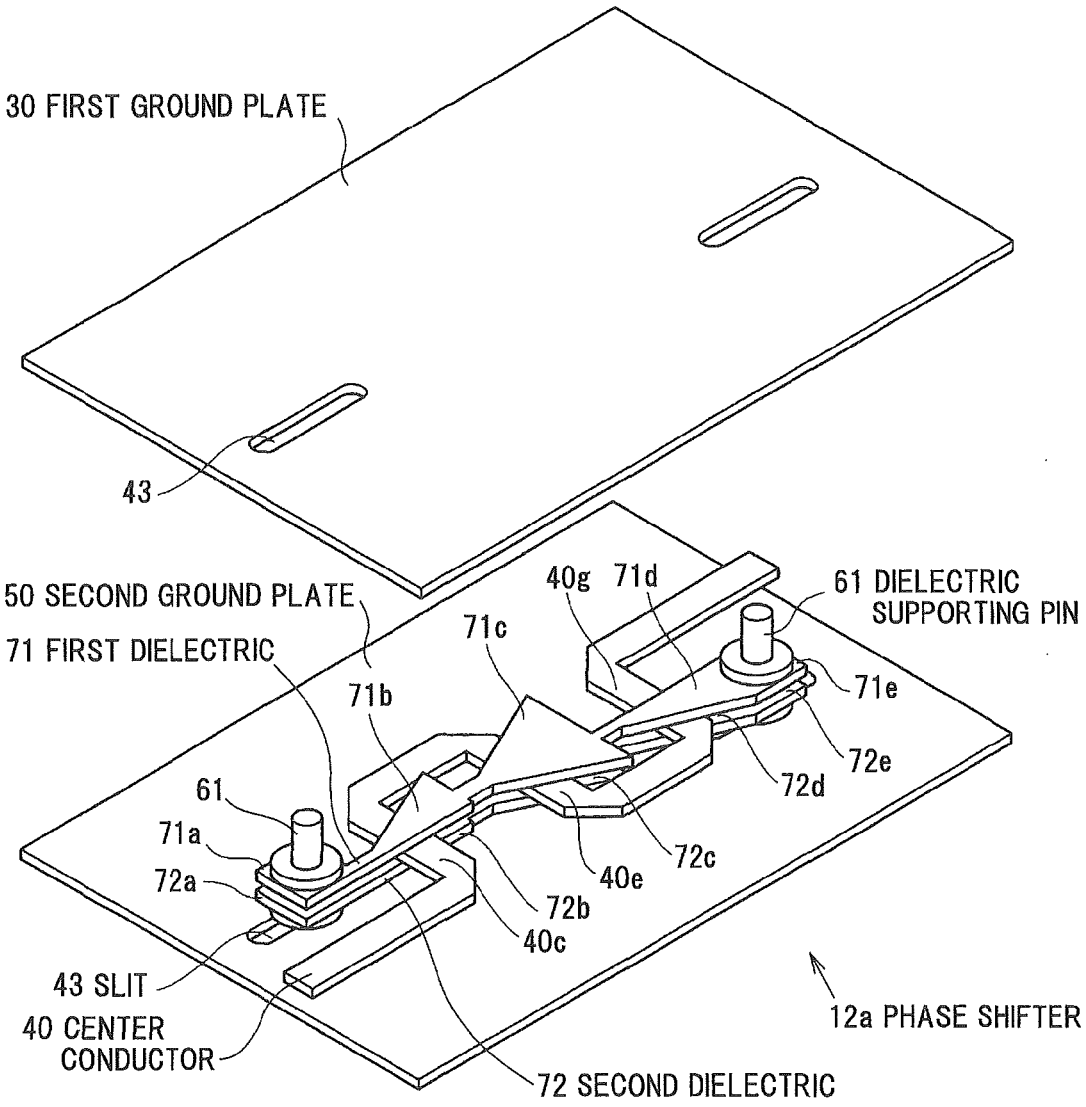
FIG. 7 is a perspective view showing a dielectric phase shifter in the mobile phone base station antenna device.

FIG. 7 is a perspective view showing a configuration example of the phase shifter 12*a* among the phase shifters 12*a* to 12*f* shown in FIG. 1B. Incidentally, the phase shifters 12*b* to 12*f* are also configured in the same way as the phase shifter 12*a*.

The phase shifter 12*a* has as a component the center conductor 40, the first dielectric plate 71 and the second dielectric plate 72, and the first ground plate 30 and the second ground plate 50. The first dielectric plate 71 is arranged opposite the first principal surface of the central conductor 40, and the second dielectric plate 72 is arranged opposite to the second principal surface of the central conductor 40. In the following description, for the sake of convenience, the first main surface and the second principal surface of the center conductor 40 may also be referred to and distinguished as "front surface" and "back surface" respectively.

The first dielectric plate 71 and the second dielectric plate 72 are integrally movable in the longitudinal direction of the phase shifter 12*a*. The first ground plate 30 is arranged on the front side of the center conductor 40 with the first dielectric plate 71 therebetween, while the second ground plate 50 is arranged on the back side of the center conductor 40 with the second dielectric plate 72 therebetween. That is, the first dielectric plate 71 and the second dielectric plate 72 are arranged between the first ground plate 30 and the second ground plate 50 with the center conductor 40 therebetween. Incidentally, in FIG. 7, for the purpose of explanation, the first ground plate 30 is illustrated as being moved upward in the drawing.

Figure 8:
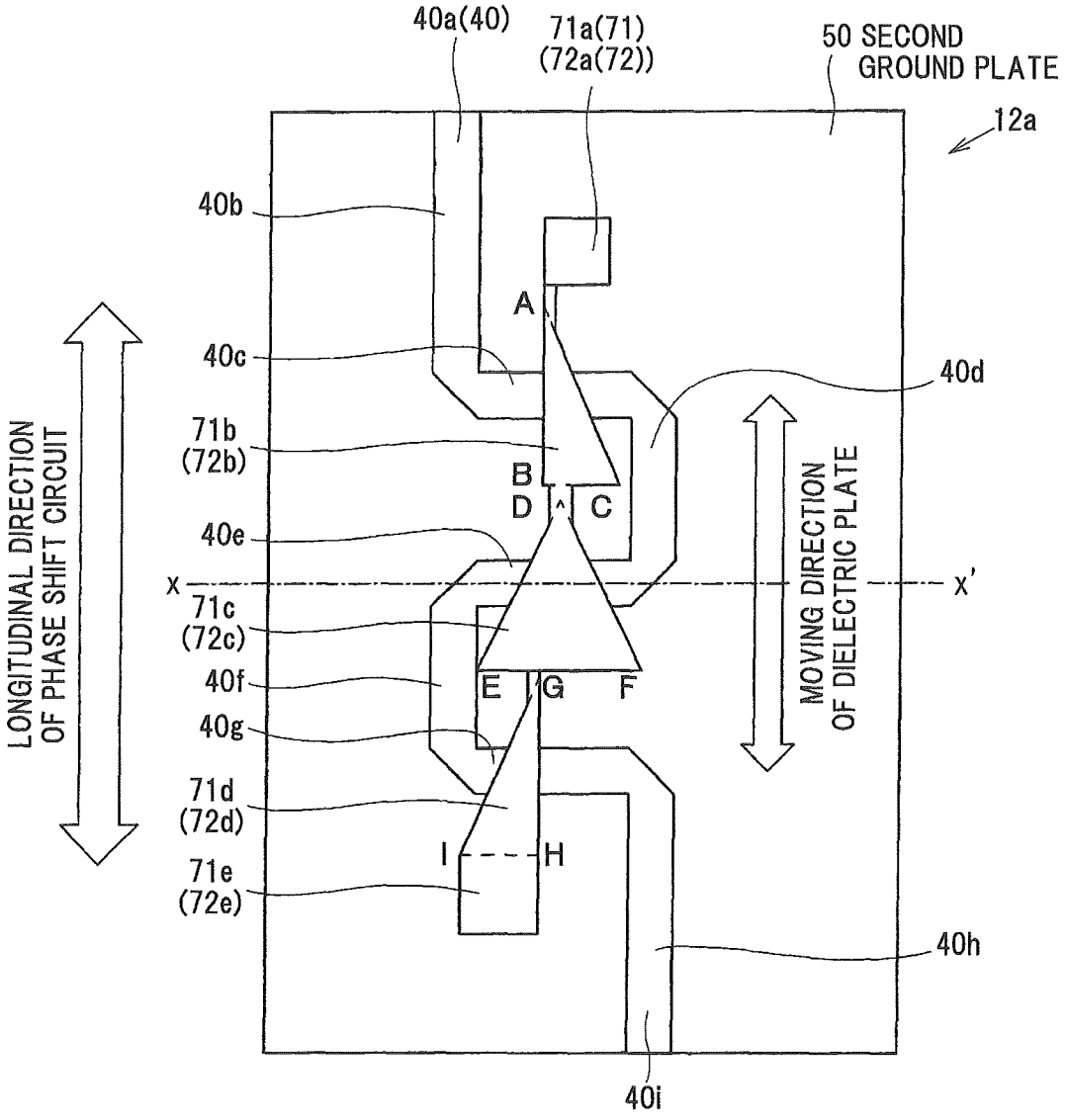
FIG. 8 is a plan view showing the dielectric phase shifter of FIG. 7.

FIG. 8 is a plan view showing the phase shifter 12*a* on the second ground plate 50.

The center conductor 40 has a signal input terminal 40*a* at one end in the longitudinal direction of the phase shifter 12*a*, and has a signal output terminal 40*i* at the other end in the longitudinal direction of the phase shifter 12*a*, and has a conductor line that connects between the signal input terminal 40*a* and the signal output terminal 40*i*. On the conductor line, there are provided a plurality of intersected portions, which extend in a direction intersecting the longitudinal direction of the phase shifter 12*a* (the longitudinal direction of the phase shift circuit shown in FIG. 8), for example, in this embodiment, in a direction perpendicular to the longitudinal direction of the phase shifter 12*a*, and a plurality of connecting portions, which extend in a direction parallel to the longitudinal direction of the phase shifter 12*a*. In other words, the conductor line is composed of the plurality of intersected portions and the connecting portions connecting the intersected portions together. The center conductor 40 of the present embodiment includes a first intersected portion 40*c*, a second intersected portion 40*e*, and a third intersected portion 40*g*, and a first connecting portion 40*b*, a second connecting portion 40*d*, a third connecting portion 40*f* and a fourth connection portion 40*h*.

One end of the first intersected portion 40*c* is connected through the first connecting portion 40*b* to the signal input terminal 40*a*. The other end of the first intersected portion 40*c* is connected through the second connecting portion 40*d* to one end of the second intersected portion 40*e*. The other end of the second intersected portion 40*e* is connected through the third connecting portion 40*f* to one end of the third intersected portion 40*g*. The other end of the third intersected portion 40*g* is connected through the fourth connecting portion 40*h* to the signal output terminal 40*i*.

In other words, the first connecting portion 40*b* and the first intersected portion 40*c* are connected in an L shape in plan view, namely the first connecting portion 40*b* and the first intersected portion 40*c* are substantially orthogonal to each other. The first intersected portion 40*c*, the second connecting portion 40*d*, and the second intersected portion 40*e* are connected in a U shape in plan view, namely in one side-opened rectangular shape. The second intersected portion 40*e*, the third connecting portion 40*f*, and the third intersected portion 40*g* are connected in a U shape in plan view. The third intersected portion 40*g* and the fourth connecting portion 40*h* are connected in an L shape in plan view.

It should be noted that the L shape includes a substantially L shape as well. Similarly, the U shape includes a substantially U shape as well.

As described above, the center conductor 40 has a line structure connected from the signal input terminal 40*a*, via the first connecting portion 40*b*, the first intersected portion 40*c*, the second connecting portion 40*d*, the second intersected portion 40*e*, the third connecting portion 40*f*, the third intersected portion 40*g* and the fourth connecting portion 40*h*, to the signal output terminal 40*i*. That is, the center conductor 40 includes the conductor line configured as a meander shaped connection of the first connecting portion 40*b*, the first intersected portion 40*c*, the second connecting portion 40*d*, the second intersected portion 40*e*, the third connecting portion 40*f*, the third intersected portion 40*g* and the fourth connecting portion 40*h*, and the conductor line is provided with the two U shaped portions thereon. Further, the outer corners of each connecting portion are chamfered.

Between the first dielectric plate 71 and the second dielectric plate 72 are located the front and back surfaces of the center conductor 40. That is, the first dielectric plate 71 and the second dielectric plate 72 are arranged so as to partially overlap the intersected portions of the center conductor 40. Specifically the first dielectric plate 71 is arranged on the front side of the center conductor 40 so as to face the center conductor 40 and partially overlap the first to third intersected portions 40*c*, 40*e*, and 40*g* of the central conductor 40. Further, the second dielectric plate 72 is arranged on the back side of the center conductor 40 so as to face the center conductor 40 and partially overlapping portions 40*c*, 40*e*, and 40*g* of the central conductor 40.

The first dielectric plate 71 and the second dielectric plate 72 are movable in the longitudinal direction of the phase shifter 12*a*. That is, the first dielectric plate 71 and the second dielectric plate 72 are movable in a direction perpendicular to the direction in which the first to third intersected portions 40*c*, 40*e*, and 40*g* of the central conductor 40 extend. Further, the first dielectric plate 71 and the second dielectric plate 72 are configured as being coupled together by respective first supporting portions 71*a* and 72*a* at one end thereof, and by respective second supporting portions 71*e* and 72*e* at the other end thereof, to move integrally in the same direction.

The first dielectric plate 71 and the second dielectric plate 72 have first overlapping portions 71*b* and 72*b*, which partially overlap the first intersected portion 40*c*, second overlapping portions 71*c* and 72*c*, which partially overlap the second intersected portion 40*e*, and third overlapping portions 71*d* and 72*d*, which partially overlap the third intersected portion 40*g*. The first to third overlapping portions 71*b*, 72*b*, 71*c*, 72*c*, 71*d*, and 72*d* each have, e.g., a triangular or substantially triangular shape in plan view.

More specifically, as shown in FIG. 8, the planar shape of the first overlapping portions 71*b* and 72*b* is a right triangle shape having vertices A, B, and C. In the following description, a side which connects the vertices A and C is referred to as a hypotenuse, a side which connects the vertices A and B is referred to as a long adjacent side, and a side which connects the vertices Band C is referred to as a short adjacent side. The planar shape of the second overlapping portions 71*c* and 72*c* is an isosceles triangle having vertices D, E, and F. In the following description, a side which connects the vertices E and F is referred to as a base, a side which connects the vertices D and E is referred to as one equilateral side, and a side which connects the vertices D and F is referred to as the other equilateral side. The planar shape of the third overlapping portions 71*d* and 72*d* is a right angled triangle having vertices G; H, and I. In the following description, a side which connects the vertices G and I is referred to as a hypotenuse, a side which connects the vertices G and H is referred to as a long adjacent side, and a side which connects the vertices Hand I is referred to as a short adjacent side.

It should be noted that the right triangle shape includes a substantially right angled triangle as well. Similarly, the isosceles triangle shape includes a substantially isosceles triangle shape as well. In addition, the long adjacent side and the short adjacent side of the right triangle refer to long one and short one, respectively, in length of the two adjacent sides. Similarly, one equilateral side and the other side of the isosceles triangle refer to one and the other one, respectively, of the two equilateral sides.

Furthermore, the vertices A of the first overlapping portions 71*b* and 72*b* are connected to the first supporting portions 71*a* and 72*a*, respectively. The vertices B of the first overlapping portions 71*b* and 72*b* are connected to the vertices D of the second overlapping portions 71*c* and 72*c*, respectively. Intermediate portions of the base connecting the vertices E and the vertices F of the second overlapping portions 71*c* and 72*c* are connected to the vertices G of the third overlapping portions 71*d* and 72*d*, respectively. The vertices H of the third overlapping portions 71*d* and 72*d* are connected to the second supporting portions 71*e* and 72*e*, respectively. These portions are interconnected via interconnecting portions respectively in shapes which allow interconnections therebetween. For example, the first supporting portions 71*a* and 72*a*, and the second supporting portions 71*e* and 72*e* have a square shape in plan view.

Then, in the first dielectric plate 71 and the second dielectric plate 72, by moving the first supporting portions 71*a* and 72*a* and the second supporting portions 71*e* and 72*e* in the longitudinal direction of the phase shifter 12*a*, it is possible to move in the longitudinal direction of the phase shifter 12*a* the first overlapping portions 71*b* and 72*b*, the second overlapping portions 71*c* and 72*c*, and the third overlapping portions 71*d* and 72*d*.

The first dielectric plate 71 and the second dielectric plate 72 are arranged as follows with respect to the center conductor 40. That is, the respective long adjacent sides which connect the respective vertices A and the respective vertices B of the first overlapping portions 71*b* and 72*b* are orthogonal to the direction of extension of the first intersected portion 40*c*. The respective hypotenuses which connect the respective vertices A and the respective vertices C of the first overlapping portions 71*b* and 72*b* intersect the direction of extension of the first intersected portion 40*c* at a first angle (e.g. 65 degrees) of less than 90 degrees. The respective other equilateral sides which connect the respective vertices D and the respective vertices F of the second overlapping portions 71*c* and 72*c* intersect the direction of extension of the second intersected portion 40*e* at a second angle (e.g. 65 degrees) of less than 90 degrees.

In addition, the respective one equilateral sides which connect the respective vertices D and the respective vertices E of the second overlapping portions 71*c* and 72*c* intersect the direction of extension of the second intersected portion 40*e* at a third angle (e.g. 65 degrees) of less than 90 degrees. The respective hypotenuses which connect the respective vertices G and the respective vertices I of the third overlapping portions 71*d* and 72*d* intersect the direction of extension of the third intersected portion 40*g* at a fourth angle (e.g. 65 degrees) of less than 90 degrees. The respective long adjacent sides which connect the respective vertices G and the respective vertices H of the third overlapping portions 71*d* and 72*d* are orthogonal to the direction of extension of the third intersected portion 40*g*.

Furthermore, the first dielectric plate 71 and the second dielectric plate 72 are arranged in such a manner as to collinearly arrange the respective long adjacent sides, which connect the respective vertices A and the respective vertices B of the first overlapping portions 71*b* and 72*b*, and the respective long adjacent sides, which connect the respective vertices G and the respective vertices H of the third overlapping portions 71*d* and 72*d*.Incidentally, the arrangement of the respective long adjacent sides connecting the respective vertices A and the respective vertices B, and the respective long adjacent sides connecting the respective vertices G and the respective vertices H is not limited to the linear arrangement, but may be a parallel arrangement configuration thereof As described above, the first dielectric plate 71 and the second dielectric plate 72 have plate shaped bodies connected from the first supporting portions 71*a* and 72*a*, via the first overlapping portions 71*b* and 72*b*, the second overlapping portions 71*c* and 72*c*, and via the third overlapping portions 71*d* and 72*d*, to the second supporting portions 71*e* and 72*e*, respectively.

In the phase shifter 12*a* which is configured as described above, when the first dielectric plate 71 and the second dielectric plate 72 are moved in the longitudinal direction of the phase shifter 12*a*, the overlapped area of the first to third overlapping portions 71*b*, 72*b*, 71*c*, 72*c*, 71*d*, and 72*d* of the first dielectric plate 71 and the second dielectric plate 72, and the first to third intersected portions 40*c*, 40*e*, and 40*g* of the center conductor 40 varies, and the phase of a signal inputted from the signal input terminal 40*a* of the center conductor 40 is controlled. In other words, a signal whose phase is advanced or retarded relative to the signal inputted to the signal input terminal 40*a* of the center conductor 40 is outputted from the signal output terminal 40*i*.

The first and second dielectric plates 71 and 72 shown in FIG. 8 are located in an intermediate position of a movable range of the first and second dielectric plates 71 and 72. Let this intermediate position be a reference, and when the first and second dielectric plates 71 and 72 are moved downward on page of FIG. 8 to a movable range lower end, the overlapped area of the first to third overlapping portions 71*b*, 72*b*, 71*c*, 72*c*, 71*d*, and 72*d*, and the first to third intersected portions 40*c*, 40*e*, and 40*g* is minimized. When the first and second dielectric plates 71 and 72 are moved upward on page of FIG. 8 to a movable range upper end, the overlapped area of the first to third overlapping portions 71*b*, 72*b*, 71*c*, 72*c*, 71*d*, and 72*d*, and the first to third intersected portions 40*c*, 40*e*, and 40*g* is maximized.

Figure 9:
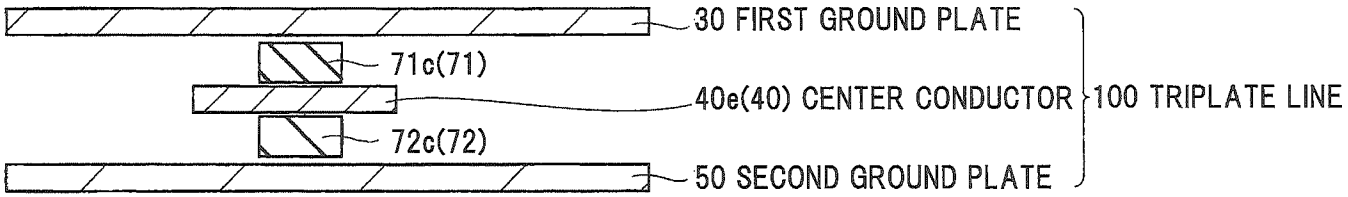
FIG. 9 is a cross sectional view showing the dielectric phase shifter of FIG. 7.

The phase shifter 12*a* shown in FIGS. 7 and 8 has such a cross-sectional structure as shown in FIG. 9. FIG. 9 shows a cross-section of the phase shifter 12*a* which is cut along the x-x' cutting line shown in FIG. 8. The x-x' cutting line is across an overlapped portion of the second intersected portion 40*e* of the center conductor 40 and the respective second overlapping portions 71*c* and 72*c* of the first dielectric plate 71 and the second dielectric plate 72. In such an overlapped portion, as shown in FIG. 9, the second intersected portion 40*e* is located between the second overlapping portions 71*c* and 72*c*.

Incidentally, although not shown, an overlapped portion of the other first intersected portion 40*c* and the first overlapping portions 71*b* and 72*b*, and an overlapped portion of the third intersected portion 40*g* and the third overlapping portions 71*d* and 72*d* also have the same cross-sectional structure. In other words, the first intersected portion 40*c* is located between the first overlapping portions 71*b* and 72*b*, and the third intersected portion 40*g* is located between the third overlapping portions 71*d* and 72*d*. It should be noted, however, that as shown in FIG. 9, the second intersected portion 40*e* and the second overlapping portions 71*c* and 72*c* are not in contact with each other. Further the other first intersected portion 40*c* and the first overlapping portions 71*b* and 72*b* are also not in contact with each other, and the third intersected portion 40*g* and the third overlapping portions 71*d* and 72*d* are also not in contact with each other.

In the first dielectric plate 71 and the second dielectric plate 72, the first supporting portion 71*a* of the first dielectric plate 71 and the first supporting portion 72*a* of the second dielectric plate 72 are coupled together with a dielectric supporting pin 61, and the second supporting portion 71*e* of the first dielectric plate 71 and the second supporting portion 72*e* of the second dielectric plate 72 are coupled together with a dielectric supporting pin 61. The dielectric supporting pins 61 are projected at both ends thereof from slits 43, respectively, which are provided in the first ground plate 30 and the second ground plate 50, and the dielectric supporting pins 61 are moved along the slits 43, respectively, by the movement of the above-mentioned coupling rods 52*a* and 52*b*, respectively.

The first dielectric plate 71 and the second dielectric plate 72 are each configured as a plate shaped dielectric made of a resin material such as glass epoxy. The first ground plate 30 and the second ground plate 50 are each configured as a plate shaped metal material such as copper, aluminum, or stainless steel. In the following description, when the first ground plate 30 and the second ground plate 50 act as an outer conductor for a triplate line, these ground plates may be referred to as a first outer conductor 30 and a second outer conductor 50, respectively.

Figure 10A:
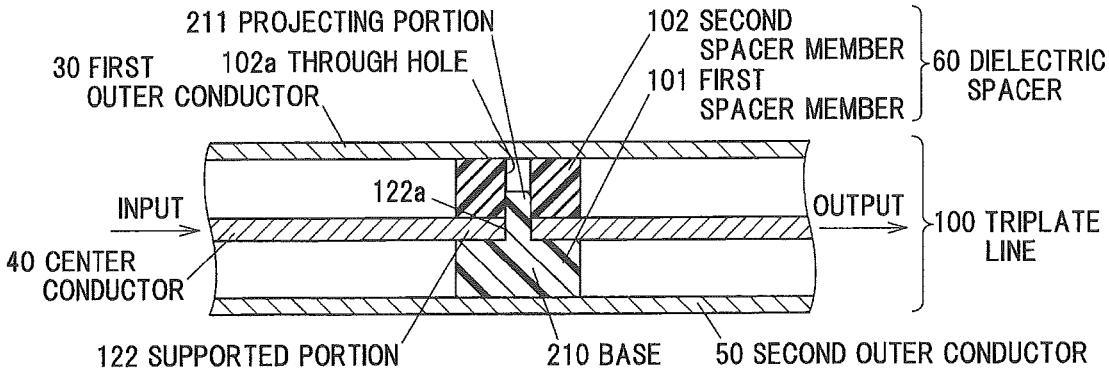
FIG. 10A is a cross sectional view showing a triplate line in the mobile phone base station antenna device.

As shown in FIG. 10A, a series of triplate lines 100 for the distributor, the dielectric phase shifter, and the feed line, respectively, comprises the first outer conductor 30 and the second outer conductor 50 arranged parallel to and at a predetermined separation from each other, and the center conductor 40 arranged in the space between the first outer conductor 30 and the second outer conductor 50. Further, between the first outer conductor 30 and the second outer conductor 50 and the central conductor 40 is interposed a dielectric spacer 60 made of a dielectric which supports the center conductor 40.

The term "a series of triplate lines 100 for the distributor, the dielectric phase shifter, and the feed line, respectively" refers to a continuous configuration of the distributor triplate line 11, the dielectric phase shifter triplate line 12, and the feed line triplate line 13, with no connector, coaxial cable, or the like interconnecting the respective triplate lines. In the present embodiment, the triplate lines 100 include the first ground plate 30 with the antenna elements 32 fixed thereto, and the second ground plate 50 arranged parallel to and at a predetermined separation from the first ground plate 30, as the one pair of outer conductors 30 and 50.

Further, although in this embodiment it is described that the first outer conductor 30 and the second outer conductor 50 and the central conductor 40 use a plate shaped body made of a conductive metal such as copper or brass, but the first outer conductor 30 and the second outer conductor 50 and the central conductor 40 may use that those formed with a metal foil on one surface or both surfaces of a plate shaped member made of e.g. resin.

The center conductor 40 has a rectangular cross section perpendicular to its extending direction, and its thickness is e.g. 1 mm. Further, the separation between the first outer conductor 30 and the second outer conductor 50 is e.g. 5 mm. It should be noted, however, that the cross-sectional shape and the thickness of the center conductor 40, and the separation between the first outer conductor 30 and the second outer conductor 50 may appropriately be set in consideration of a target value of the characteristic impedance, etc., of the triplate lines 100.

Figure 10B:
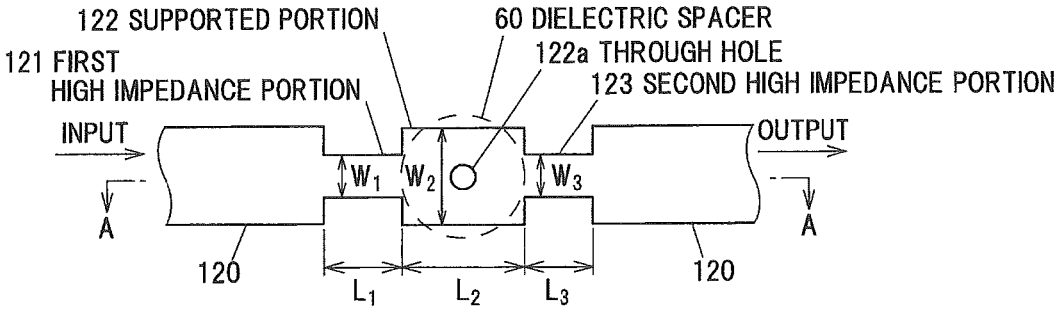
FIG. 10B is a plan view showing a center conductor of the triplate line of FIG. 10A.

FIG. 10B shows the center conductor 40 in a peripheral portion of a portion supported by the dielectric spacer 60. The center conductor 40 includes a supported portion 122 supported by the dielectric spacer 60, a first high impedance portion 121 formed along the extending direction of the center conductor 40 and on one side (input side) of the supported portion 122, and a second high impedance portion 123 formed along the extending direction of the center conductor 40 and on the other side (output side) of the supported portion 122. Also, in the following description, of the center conductor 40, a portion excluding the first high impedance portion 121, the supported portion 122, and the second high impedance portion 123 is referred to as a body portion 120. The supported portion 122 is formed with a through hole 122*a* in its middle, which penetrates the center conductor 40 in a thickness direction.

A line width dimension in a width direction perpendicular to the extending direction (horizontal direction of FIGS. 10A and 10B) of the center conductor 40 is formed more narrowly than the body portion 120 and the supported portion 122 in the first high impedance portion 121 and the second high impedance portion 123. The line width $W_2$ of the supported portion 122 is e.g. 4 to 6 mm, and the line width $W_1$ of the first high impedance portion 121 and the line width $W_3$ of the second high impedance portion 123 are e.g. 2 to 3 mm. Also, the diameter of the through hole 122*a* formed in the supported portion 122 is e.g. 2 to 3 mm.

As shown in FIG. 10A, the dielectric spacer 60 is formed by combining a first spacer member 101 and a second spacer member 102. The first spacer 101 integrally has a disc shaped base 210 and a cylindrical projecting portion 211 provided as projecting from the base 210. The diameter of the base 210 is larger than the line width $W_2$ of the supported portion 122, and is e.g. 5 to 7 mm. Also, the thickness of the base 210 is e.g. 2 mm.

The second spacer member 102 is in a disc shape with a mating hole 102*a* in a central portion into which the projecting portion 211 of the first spacer member 101 is mated. The diameter (outer diameter) and thickness of the second spacer member 102 are the same as the diameter and thickness of the base 210 of the first spacer member 101. The mating hole 102*a* is penetrated in the thickness direction of the second spacer member 102.

The projecting portion 211 of the first spacer member 101 is inserted through the through hole 122*a* in the supported portion 122 of the central conductor 40 and is mated into the mating hole 102*a* in the second spacer member 102. The base 210 of the first spacer member 101 is arranged between the center conductor 40 and the second outer conductor 50. The second spacer member 102 is arranged between the center conductor 40 and the first outer conductor 30. The dielectric spacer 60 supports the center conductor 40 in the supporting portion 122 by the first spacer member 101 and the second spacer member 102 being integral so as to sandwich the supported portion 122 of the central conductor 40 therebetween.

By being supported by the dielectric spacer 60, the characteristic impedance at the supported portion 122 of the respective triplate lines 100 is lower than the characteristic impedance of the supported portion 122 itself (i.e. the characteristic impedance at the supported portion 122 in the absence of the dielectric spacer 60). In the following description, the characteristic impedance of the supported portion 122 is assumed to refer to the characteristic impedance at the supported portion 122 when supported by the dielectric spacer 60.

In addition, if the dielectric spacer 60 is interposed between the center conductor 40, and the first outer conductor 30 and the second outer conductor 50, and is capable of supporting the center conductor 40 at the supported portion 122, the dielectric spacer 60 is then not limited to the structure and the state as shown in FIG. 10. For example, the second spacer member 102 and the base 210 of the first spacer member 101 are not limited to the circular shape, but may be e.g. a rectangular shape. Further, if the dielectric spacer 60 per se is a dielectric, its material is not particularly limited, but may preferably use a resin such as polyethylene.

The characteristic impedance $Z_1$ of the first high impedance portion 121 and the characteristic impedance Z3 of the second high impedance portion 123 are values higher than the characteristic impedance Z2 (Zt>Z2 and Z3>Z2) at the supported portion 122 supported by the dielectric spacer 60. Preferably, the characteristic impedance $Z_1$ of the first high impedance portion 121 and the characteristic impedance $Z_3$ of the second high impedance portion 123 are higher than the characteristic impedance $Z_0$ of the body portion 120 of the center conductor 40. In this case, the characteristic impedance $Z_2$ at the supported portion 122 is the same as the characteristic impedance $Z_0$ of the body portion 120 or is lower than the characteristic impedance $Z_0$, i.e. $Zt>Z_0$ Z2 and $Z3>Z_0$ Z2. Further, the characteristic impedance $Z_1$ of the first high impedance portion 121 and the characteristic impedance $Z_3$ of the second high impedance portion 123 may be the same value ($Z_1=Z_3$), or different values (Zt>Z3 or Zt<Z3).

The impedance adjustment of the first high impedance portion 121 and the second high impedance portion 123 can be carried out depending on the set values of the characteristic impedances $Z_1$ and $Z_3$ and by setting line widths $W_1$ and $W_3$ and line lengths $L_1$ and L3 thereof.

By, in this manner, providing the first high impedance portion 121 and the second high impedance portion 123 having the high impedance than the characteristic impedance Z2 at the supported portion 122 on the input side and the output side of the supported portion 122 whose characteristic impedance is lowered by being supported by the dielectric spacer 60, and by matching the impedances of the entire triplate lines 100, it is possible to suppress the reflection of a high frequency signal.

Further, since it is possible to make the line width $W_2$ of the supported portion 122 larger than the respective line widths $W_1$ and $W_3$ of the first high impedance portion 121 and the second high impedance portion 123, it is possible to ensure the strength of the supported portion 122 even if the through hole 122*a* is formed therein. That is, it is possible to suppress reflection at the triplate lines 100 while ensuring the strength of the supported portion 122.

Next, the basic idea of the impedance matching as described above will be described using a Smith chart.

Figure 11A:
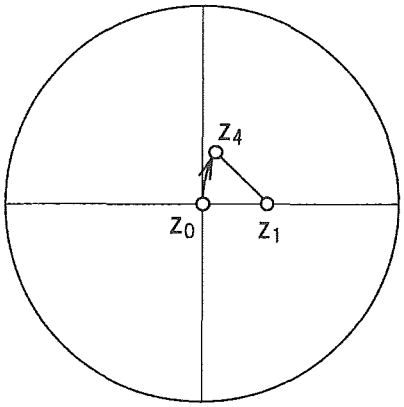
FIG. 11A is an explanatory diagram showing the movement of the characteristic impedance due to the provision of a first high impedance portion.
Figure 11B:
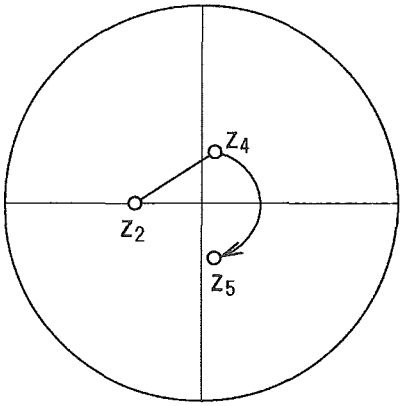
FIG. 11B is an explanatory diagram showing the movement of the characteristic impedance due to the provision of a supported portion.
Figure 11C:
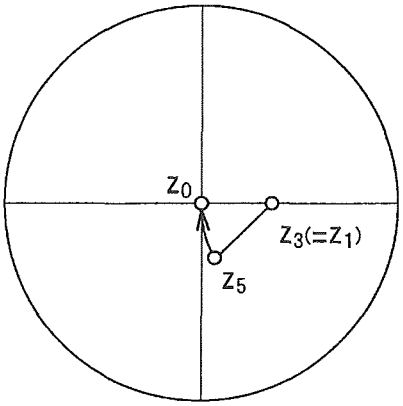
FIG. 11C is an explanatory diagram showing the movement of the characteristic impedance due to the provision of a second high impedance portion.

FIGS. 11A to 11C are diagrams for explaining the impedance matching of the triplate lines 100. More specifically, FIG. 11A is the Smith chart showing a change in the characteristic impedance due to the provision of the first high impedance portion 121; FIG. 11B is the Smith chart showing a change in the characteristic impedance due to the provision of the supported portion 122; and FIG. 11C is the Smith chart showing a change in the characteristic impedance due to the provision of the second high impedance portion 123. Normalized impedance is typically plotted on the Smith chart, but, for convenience of explanation, the respective characteristic impedance of each portion of the respective triplate lines 100 is directly plotted herein.

As shown in FIG. 11A, when there is provided the first high impedance portion 121 (characteristic impedance $Z_1$), the characteristic impedance moves by the line length $L_1$ thereof from $Z_0$ to Z4. Subsequently, since the supported portion 122 (characteristic impedance Z2) is provided on the output side of the first high impedance portion 121, the characteristic impedance Z4 moves, depending on the line length of the supported portion 122, to the characteristic impedance $Z_5$ at a symmetrical position with respect to a horizontal axis showing the real part of the complex reflection coefficient on the Smith Chart. Further, by being provided with the second high impedance portion 123 (characteristic impedance Z3) on the output side of the supported portion 122, the characteristic impedance $Z_5$ returns by the line length L3 to the characteristic impedance $Z_0$ of the body portion of the respective trip late lines 100, and the impedance matching at the respective triplate lines 100 is ensured when viewed from the input side. As a result, signal reflection is suppressed.

Next, a description will be given of impedance matching when considering the mechanical strength of the supported portion 122, widening and setting the line width of the supported portion 122.

Figure 12A:
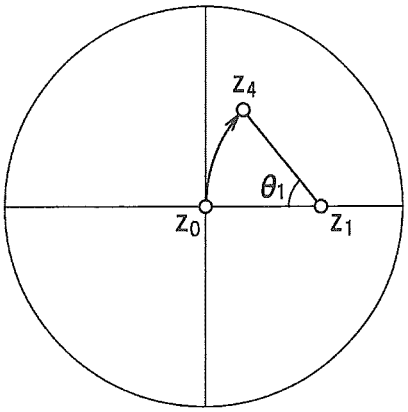
FIG. 12A is an explanatory diagram showing changes of the characteristic impedance at the first high impedance portion due to widening of a line of the supported portion.
Figure 12B:
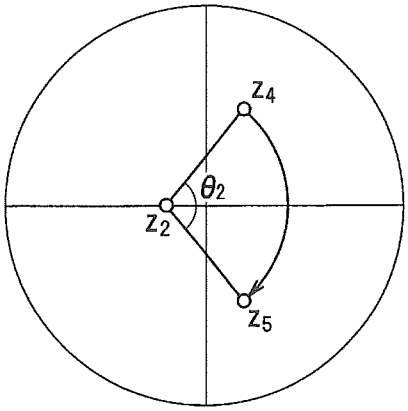
FIG. 12B is an explanatory diagram showing changes of the characteristic impedance at the supported portion due to the widening of the line of the supported portion.
Figure 12C:
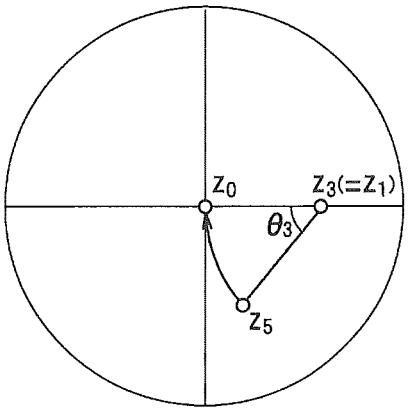
FIG. 12C is an explanatory diagram showing changes of the characteristic impedance at the second high impedance portion due to the widening of the line of the supported portion.

FIGS. 12A to 12C are diagrams for explaining the impedance matching when widening and setting the line width of the supported portion 122, in the respective triplate lines 100. More specifically, FIG. 12A is the Smith chart showing a change in the characteristic impedance due to the provision of the first high impedance portion 121; FIG. 12B is the Smith chart showing a change in the characteristic impedance due to the provision of the supported portion 122; and FIG. 12C is the Smith chart showing a change in the characteristic impedance due to the provision of the second high impedance portion 123.

When setting the line length L2 and the line width W2 of the supported portion 122, the characteristic impedance Z2 of the supported portion 122 is determined, and the angle 82 and the amount of movement of the impedance from Z4 to $Z_5$ in FIG. 12B are determined And, the characteristic impedance $Z_1$ of the first high impedance portion 121 and the characteristic impedance Z3 of second high impedance portion 123 are adjusted to match the Z4 and Zs in FIG. 12B.

Specifically, as shown in FIG. 12A, the line width $W_1$ and the line length $L_1$ of the first high impedance portion 121 are set so that the characteristic impedance $Z_1$ of the first high impedance portion 121 matches a point where a straight line which tilts at an angle $\mathbf{8}_1$ ($\mathbf{8}_1$=82/2) with respect to the horizontal axis of the Smith chart and which passes through the Z4 intersects the horizontal axis.

Further, as shown in FIG. 12C, the line width $W_3$ and line length $L_3$ of the second high impedance portion 123 are set so that the characteristic impedance $Z_3$ of the second high impedance portion 123 matches a point where a straight line which tilts at an angle $\mathbf{8}_3$ ($\mathbf{8}_3$=$\mathbf{8}_2$/2) with respect to the horizontal axis of the Smith chart and which passes through the $Z_5$ intersects the horizontal axis. Thus, the impedance matching is ensured, and signal reflection is suppressed, and it is possible to ensure the mechanical strength of the supported portion.

In the configuration shown in FIGS. 2 to 10 described above, that is, the configuration using the respective triplate lines 100 in which the center conductor 40 is arranged between the first ground plate 30 and the second ground plate 50 as the first outer conductor and the second outer conductor, respectively, as the transmission lines from the radio frequency signal transmitting/receiving terminal 10, to the antenna elements 32 (corresponding to the antenna elements 14*a* to 14*h* of the antenna element array 14 in FIGS. 1A and 1B), when a horizontally polarized high frequency signal and also a vertically polarized high frequency signal are each provided from the coaxial cable 55*a* and the coaxial cable 55*b*, respectively, to between the center conductor 40 and the first and second outer conductors 30 and 50 of the distributor triplate line 11, and are distributed to the triplate line 100 as the eight feed line triplate lines 13 (FIGS. 1A and 1B).

Since in the triplate line 100 the dielectric phase shifters (FIGS. 7 to 9) as the phase shifter 12*a* to 12*f* (FIG. 1B) are configured as the first and second dielectric plates 71 and 72, the horizontally polarized and vertically polarized high frequency signals having a predetermined phase shift amount are provided from the triplate line 100 as the feed line triplate line 13 to the eight antenna elements 32. Thus, the respective horizontally polarized antenna elements 32*a* of the antenna elements 32 radiate the horizontally polarized signal, while the respective vertically polarized antenna elements 32*b* of the antenna elements 32 radiate the vertically polarized signal.

Here, since the triplate lines 100 for the distributor, the dielectric phase shifter, and the feed line, respectively, include the dielectric spacer 60 at the predetermined separation, and also the width of the center conductor 40 is set at the predetermined width as $W_1$, $W_2$, and $W_3$ (FIGS. 6, 10A and 10B), reflection due to impedance mismatch is lowered over the entire length of the respective triplate lines 100.

In addition, losses of the triplate lines 100 (the triplate lines 11 and 12 in FIGS. 1A and 1B) for the distributor and the dielectric phase shifter, respectively, are shown in Table 1 below.

TABLE 1

| Frequency (GHz) | Loss in triplate line 100 for dielectric phase shifter (dB) |
|---|---|
| 1.4 | 0.5 |
| 1.5 | 0.6 |
| 1.6 | 0.6 |
| 1.7 | 0.6 |
| 1.8 | 0.6 |
| 1.9 | 0.6 |
| 2.0 | 0.6 |
| 2.1 | 0.7 |
| 2.2 | 0.7 |

The losses (not less than 0.5 dB and not more than 0.7 dB in a frequency band of not less than 1.4 GHz and not more than 2.2 GHz) in Table 1 above are values obtained by subtracting a loss (dB) of the coaxial cables 55*a* to 55*b* for input from a loss (dB) of the plate lines 100 for the distributor and the dielectric phase shifter, respectively, including the coaxial cables 55*a* to 55*b* for input.

(Operation and Effects of the Embodiment)

With the mobile phone base antenna device 1 in the embodiment according to the present invention described above, it is possible to achieve the following effects.

(1) Because the feed line transmission line 13 is composed of the triplate line 100, it is possible to suppress the occurrence of loss from the phase shifters 12*a* to 12*f* to the antenna elements 32, thereby it is possible to achieve high efficiency of the mobile phone base antenna device 1. Incidentally, the triplate line 100 may be a seamless metal plate shape line or a metal pipe type line.

(2) Because the triplate lines 100 for the distributor, the dielectric phase shifter, and the feed line, respectively, can continuously be configured via no connecting portion such as a connector or the like, it is possible to further reduce the occurrence of loss.

(3) Since the phase shifters 12*a* to 12*f* have the structure in which the triplate line 100 is partially provided with the first and the second dielectric plates 71 and 72, configuration thereof is simple, and also as shown in Table 1, it is possible to reduce the loss in the frequency band of not less than 1.4 GHz and not more than 2.2 GHz to a small level of 0.7 dB or less.

(4) Since the respective triplate lines 100 have the structure for impedance matching, it is possible to suppress loss due to signal reflection.

(Summary of the Embodiment)

Next, the technical concept that is ascertained from the embodiment described above will be described with the aid of reference characters and the like in the embodiment. It should be noted, however, that each of the reference characters in the following description should not be construed as limiting the constituent elements in the claims to the members and the like specifically shown in the embodiment.

[1] An antenna device (1), comprising: an input/output portion (10) for a high frequency signal to be input or output; a distributing portion (11) for distributing the high frequency signal input to the input/output portion (10) into a plurality of high frequency signals; a phase shifting portion (12) for imparting the plurality of high frequency signals with a predetermined amount of phase shift; and a feeding portion (13) for feeding a plurality of antenna elements (32) with the plurality of high frequency signals imparted with the predetermined amount of phase shift to cause the plurality of antenna elements (32) to radiate the plurality of high frequency signals, wherein the feeding portion (13) is configured as a triplate line (100) with a center conductor (40) placed between one pair of parallel plate shaped outer conductors (30, 50).

[2] The antenna device (1) according to [1] above, wherein the phase shifting portion (12) is configured as a dielectric phase shifter (12*a* to 12*f*) comprising a triplate line (100) with a center conductor (40) placed between one pair of parallel plate shaped outer conductors (30, 50), and first and second dielectrics (71, 72) provided partially on and under the center conductor (40) therebetween and movably in a longitudinal direction of the center conductor, the first and second dielectrics (71, 72) comprising a varying width in the longitudinal direction.

[3] The antenna device (1) according to [1] or [2] above, wherein the distributing portion (11) is configured as a triplate line (100) with a center conductor (40) placed between one pair of parallel plate shaped outer conductors (30, 50).

[4] The antenna device (1) according to [3] above, wherein the distributing portion (11) is configured as including the phase shifting portion (12).

[5] The antenna device (1) according to [1] above, wherein the distributing portion (11), the phase shifting portion (12), and the feeding portion (13) are configured as a series of triplate lines (100) each with a center conductor (40) placed between one pair of parallel plate shaped outer conductors (30, 50).

[6] The antenna device (1) according to [5] above, wherein the triplate lines each include a first ground plate (30) with the antenna elements (32) fixed thereto, and a second ground plate (50) arranged parallel to and at a predetermined separation from the first ground plate (30), as the one pair of outer conductors (30, 50).

[7] The antenna device (1) according to any one of [1] to [6] above, wherein the phase shifting portion (12) has a loss of not greater than 0.7 dB in a frequency band of not lower than 1.4 GHz and not higher than 2.2 GHz.

Although the embodiment of the present invention has been described above, the embodiment described above should not be construed to limit the invention in the appended claims. It should also be noted that not all the combinations of the features described in the above embodiment are essential to the means for solving the problems of the invention.

Further, the present invention may be appropriately modified and practiced without departing from the spirit thereof. For example, although in the above embodiment it has been described that the mobile phone base station antenna device 1 is used for transmission, this mobile phone base station antenna device 1 may be used for reception as well. Further, the present invention is not limited to use for the mobile phone base station, but may be applied to antenna devices in various applications.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An antenna device, comprising:

an input/output portion for a high frequency signal to be input or output;

a distributing portion for distributing the high frequency signal input to the input/output portion into a plurality of high frequency signals;

a phase shifting portion for imparting the plurality of high frequency signals with a predetermined amount of phase shift; and a feeding portion for feeding a plurality of antenna elements with the plurality of high frequency signals imparted with the predetermined amount of phase shift to cause the plurality of antenna elements to radiate the plurality of high frequency signals, wherein the feeding portion is configured as a triplate line with a center conductor placed between one pair of parallel plate shaped outer conductors, wherein the phase shifting portion is configured as a dielectric phase shifter comprising a triplate line with a center conductor placed between one pair of parallel plate shaped outer conductors, and first and second dielectrics provided partially on and under the center conductor therebetween and movably in a longitudinal direction of the center conductor, the first and second dielectrics comprising a varying width in the longitudinal direction.

2. The antenna device according to claim 1, wherein the distributing portion is configured as a triplate line with a center conductor placed between one pair of parallel plate shaped outer conductors.

3. The antenna device according to claim 2, wherein the distributing portion is configured as including the phase shifting portion.

4. The antenna device according to claim 1, wherein the distributing portion, the phase shifting portion, and the feeding portion are configured as a series of triplate lines each with a center conductor placed between one pair of parallel plate shaped outer conductors.

5. The antenna device according to claim 4, wherein the triplate lines each include a first ground plate with the antenna elements fixed thereto, and a second ground plate arranged parallel to and at a predetermined separation from the first ground plate, as the one pair of outer conductors.

6. The antenna device according to claim 1, wherein the phase shifting portion has a loss of not greater than 0.7 dB in a frequency band of not lower than 1.4 GHz and not higher than 2.2 GHz.

* * * * *